US008482373B1

(12) United States Patent
Tseng et al.

(10) Patent No.: US 8,482,373 B1
(45) Date of Patent: Jul. 9, 2013

(54) OVER-CURRENT PROTECTION DEVICE

(71) Applicant: Polytronics Technology Corp., Hsinchu (TW)

(72) Inventors: Chun Teng Tseng, Miaoli (TW); David Shau Chew Wang, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 0 days.

(21) Appl. No.: 13/718,953

(22) Filed: Dec. 18, 2012

(30) Foreign Application Priority Data

Jul. 31, 2012 (TW) ..... 101127721 A

(51) Int. Cl.
*H01C 7/10* (2006.01)

(52) U.S. Cl.
USPC ..... 338/20; 338/22 R; 338/309; 338/328; 338/332

(58) Field of Classification Search
USPC ..... 338/22 R, 309, 328, 332
See application file for complete search history.

(56) References Cited

U.S. PATENT DOCUMENTS

| | | | | |
|---|---|---|---|---|
| 6,606,023 | B2 * | 8/2003 | Chiang et al. | 338/22 R |
| 6,665,164 | B2 * | 12/2003 | Chu et al. | 361/106 |
| 6,809,626 | B2 * | 10/2004 | Chu et al. | 337/167 |
| 6,873,244 | B2 * | 3/2005 | Huang et al. | 338/22 R |
| 7,609,143 | B2 * | 10/2009 | Huang | 338/22 R |
| 7,715,164 | B2 * | 5/2010 | Huang et al. | 361/106 |

* cited by examiner

*Primary Examiner* — Kyung Lee
(74) *Attorney, Agent, or Firm* — Shimokaji & Associates P.C.

(57) ABSTRACT

An over-current protection device comprises a PTC material layer, first and second conductive layers, first and second electrodes, and four conductive vias. The first and second conductive layers are in physical contact with first and second surfaces of the PTC material layer, respectively. The first electrode contains a pair of first metal foils, and the second electrode contains a pair of second metal foils. The four conductive vias are formed at the corners each defined by two adjacent planar lateral surfaces. Two conductive vias connect the pair of the first metal foils and the first conductive layer, and the other two conductive vias connect the pair of the second metal foils and the second conductive layer. The ratio of the sum of the cross-sectional areas of the conductive vias to a form factor area of the device is in the range of 7% to 20%.

12 Claims, 6 Drawing Sheets

OVER-CURRENT PROTECTION DEVICE

BACKGROUND OF THE INVENTION (1) Field of the Invention

The present application relates to an over-current protection device, and more particularly to a surface-mountable over-current protection device.

(2) Description of the Related Art

Over-current protection devices are used for protecting circuitries from damage resulted from over-heat or over-current. An over-current protection device usually contains two electrodes and a resistive material disposed therebetween. The resistive material has positive temperature coefficient (PTC) characteristic that the resistance thereof remains extremely low at room temperature and instantaneously increases to thousand times when the temperature reaches a critical temperature or the circuit has over-current, so as to suppress over-current and protect the cell or the circuit device. When the resistive material gets back to the room temperature or over-current no longer exists, the over-current protection device returns to be of low resistance and as a consequence the circuitry again operate normally. In view of the reusable property, the PTC over-current protection devices can replace traditional fuses, and have been widely applied to high density circuits.

Referring to FIG. 1, U.S. Pat. No. 6,377,467 disclosed a surface mountable over-current protection device 10 containing a resistive device 11, a first electrode 17, a second electrode 18, insulating layers 15 and 16, a first conductive via 19 and a second conductive via 20. The resistive device 11 contains a first conductive member 13, a second conductive member 14 and a polymeric material layer 12. The polymeric material layer 12 is stacked between the first conductive member 13 and the second conductive member 14. The first electrode 17 comprises a pair of electrode foils disposed on the insulating layers 15 and 16, and is coupled to the first conductive via 19. The second electrode 18 comprises a pair of electrode foils disposed on the insulating layers 15 and 16, and is coupled to the second conductive via 20. The conductive vias 19 and 20 are approximately placed at the centers of two opposite planar lateral surfaces and are in the shape of semi-circular holes.

Electronic apparatuses are being developed with reducing size trend. Therefore, it is desirable to use small over-current protection devices. For example, the form factor of the devices has been advanced from 1210, 1206, 0805, 0603, 0402 to 0201. However, the conductive vias 19 and 20 in the form of semi-circular holes will encounter manufacturing problems when the devices have been shrunk to below 0603.

Referring to FIGS. 2A and 2B, normally, the smaller the devices, the smaller the hole sizes of the conductive vias 19 and 20 are. For example, the radius of the semi-circular conductive via is around 0.15 mm for a 0603-type device. In the manufacturing process of cutting to form devices, the width "d" of the cutter has to be aligned with the cutting line (see FIG. 2A). However, if the cutter is misaligned, it is likely to cut off a large amount of a conductive via of one of the adjacent devices, or even remove the entire conductive via (see FIG. 2B). Smaller devices have to have large semi-circular conductive vias to avoid the problem. Nevertheless, large conductive vias further generate other manufacturing process issues as mentioned below.

When the over-current protection devices are subjected to appearance inspection, resistance measurement or packaging process, they are pushed one-by-one in a track 24. If the devices 10 have smaller semi-circular conductive vias, they could be smoothly pushed to go forward, as shown in FIG. 3A. If the devices 10 have larger semi-circular vias especially the ones of which the concave semi-circular conductive via having a width greater than half the side width of the device 10, the protrusions of a device 10 would be engaged with the concave semi-circular conductive via of the one next to it, resulting in unstable transmission or blockage of the devices 10, as shown in FIG. 3B.

As the advancement of the devices of 0603, 0402 or even smaller type is vital for new applications, it is highly demanded to have a solution on how to obviate the manufacturing issues mentioned above.

SUMMARY OF THE INVENTION

The present application relates to an over-current protection device, and more particularly to a surface mountable over-current protection device. It can meet the requirements of compact devices such as 0603, 0402 or the smaller ones.

In accordance with an embodiment of the present application, an over-current protection device has opposite upper and lower surfaces and four planar lateral surfaces interconnecting the upper and lower surfaces. Each of two adjacent ones of the planar lateral surfaces defines a corner therebetween; therefore there are four corners at the interconnections of adjacent planar lateral surfaces. The over-current protection device comprises a PTC material layer, a first conductive layer, a second conductive layer, a first electrode, a second electrode and four conductive vias. The PTC material layer contains opposite first and second surfaces, the first conductive layer being in physical contact with the first surface, and the second conductive layer being in physical contact with the second surface. The first electrode comprises a pair of first metal foils at the upper and lower surfaces. The first electrode is electrically connected to the first conductive layer and is electrically isolated from the second conductive layer. The second electrode comprises a pair of second metal foils at the upper and lower surfaces. The second electrode is electrically connected to the second conductive layer and is electrically isolated from the first conductive layer. Four conductive vias are formed on the four corners in which two conductive vias connect the pair of the first metal foils and the first conductive layer, and the other two connect the pair of the second metal foils and the second conductive layer. The sum of the cross-sectional areas of the four conductive vias is around 7%-20% of a form factor area of the over-current protection device.

In an embodiment, the present application is applied to an over-current protection device of 0603 type, in which the cross-sectional area of one of the conductive vias is in the range of 0.025-0.042 $mm^2$.

In another embodiment, the present application is applied to an over-current protection device of 0402 type, in which the cross-sectional area of one of the conductive vias is in the range of 0.009-0.020 $mm^2$.

According to the present application, the conductive vias are allowed to be made larger even for a small device, thereby providing larger tolerance in cutting process. Moreover, there is no blockage of the devices caused by their larger conductive vias in the processes of appearance inspection, resistance measurement or packaging. Not only does the novel design of the present application increase the production throughput but also it benefits the production yield.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 4A:
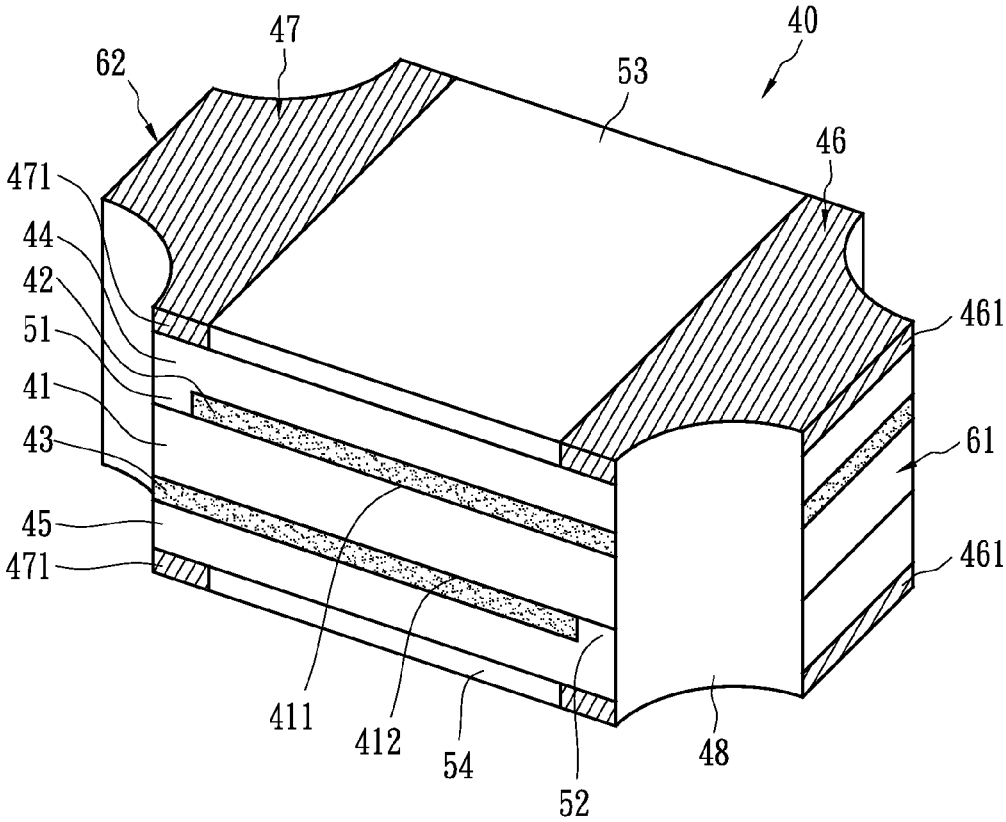
FIGS. 4A to 4C show an over-current protection device in accordance with an embodiment of the present application.

FIG. 4A shows an over-current protection device in accordance with an embodiment of the present application. An over-current protection device 40 is of a cuboid structure and has opposite upper and lower surfaces and four planar lateral surfaces interconnecting the upper and lower surfaces. Each of two adjacent ones of the four planar lateral surfaces defines a corner; accordingly, the over-current protection device 40 contains four corners. The over-current protection device 40 comprises a PTC material layer 41, a first conductive layer 42, a second conductive layer 43, a first insulating layer 44, a second insulating layer 45, a first electrode 46, a second electrode 47 and four conductive vias 48. The PTC material layer 41 has a first surface 411 and a second surface 412 which is opposite to the first surface 411. The first conductive layer 42 is in physical contact with the first surface 411 of the PTC material layer 41, whereas the second conductive layer 43 is in physical contact with the second surface 412 of the PTC material layer 41. The first electrode 46 comprises a pair of first metal foils 461 at the upper and lower surfaces. The first electrode 46 is electrically connected to the first conductive layer 42 and is electrically isolated from the second conductive layer 43. The second electrode 47 comprises a pair of second metal foils 471 at the upper and lower surfaces. The second electrode 47 is electrically connected to the second conductive layer 43 and is electrically isolated from the first conductive layer 42. Four conductive vias 48 are formed on the four corners of adjacent planar lateral surfaces in which two conductive vias 48 connect the pair of the first metal foils 461 and the first conductive layer 42, and another two conductive vias 48 connect the pair of the second metal foils 471 and the second conductive layer 43.

The first insulating layer 44 is formed on the first conductive layer 42, and the second insulating layer 45 is formed on the second conductive layer 43. The metal foils 461 and 471 at the upper surface are formed on the first insulating layer 44, and the metal foils 461 and 471 at the lower surface are formed on the second insulating layer 45.

In an embodiment, a first solder mask 53 is formed on the first insulating layer 44 and between the first metal foil 461 and the second metal foil 471 at the upper surface. A second solder mask 54 is formed on the second insulating layer 45 and between the first metal foil 461 and the second metal foil at the lower surface.

In an embodiment, the cross-section of the conductive via 48 is quarter-round. Alternatively, the cross-section can be of arched, square, rectangular, triangular or polygonal shape.

Figure 4B:
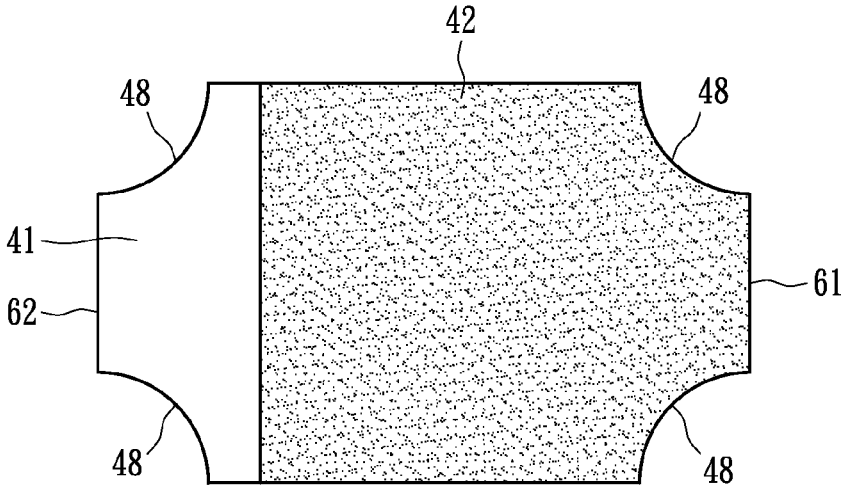
Figure 4C:
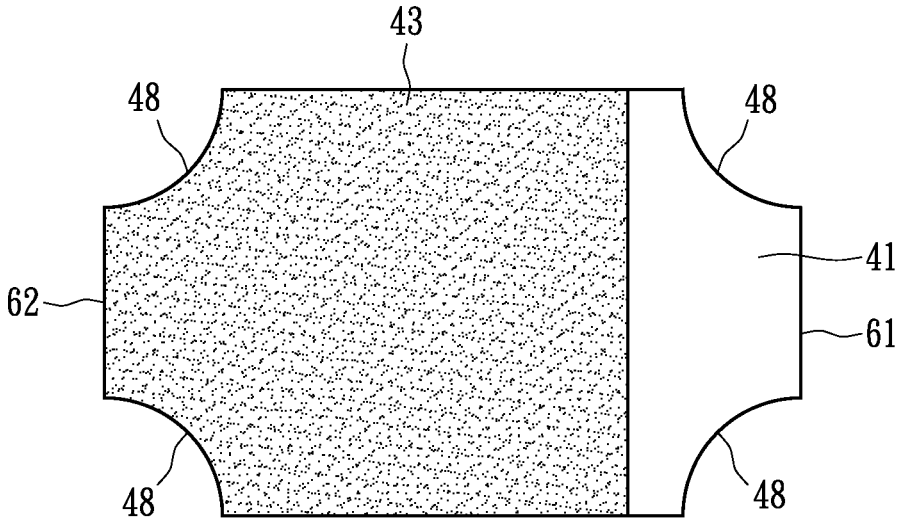

FIG. 4B shows the top view of the first conductive layer 42 and the PTC material layer 41, whereas FIG. 4C is the bottom view of the second conductive layer 43 and the PTC material layer 41. Referring to FIGS. 4A and 4B, a first planar lateral surface 61 is opposite to a second planar lateral surface 62. The first conductive layer 42 extends to the first planar lateral surface 61, and a gap 51 is between the first conductive layer 42 and the second planar lateral surface 62. Referring to FIGS. 4A and 4C, the second conductive layer 43 extends to the second planar lateral surface 62, and a gap 52 is formed between the second conductive layer 43 and the first planar lateral surface 61.

More specifically, the upper and lower surfaces of the PTC material layer 41 are provided with the first conductive layer 42 and the second conductive layer 43, respectively. The first conductive layer 42 and the second conductive layer 43 extend to the opposite planar lateral surfaces 61 and 62, respectively. The conductive layers 42 and 43 can be made from metal foils of which the gaps 51 and 52 may be formed by laser cutting, chemical etching or mechanical machining. The gaps 51 and 52 are not restricted to those embodiments shown in the drawings, other shapes or figures capable of forming isolation can be used for the present application also. The area of the gap 51 or 52 is preferably less than 25% of the form factor area of the device 40.

The PTC material layer 41 comprises crystalline polymer and conductive filler and exhibits PTC characteristic. The crystalline polymer may comprise polyethylene, polypropylene, polyvinylfluoride, the mixture or the copolymer thereof. The conductive filler may comprise metal fillers, carbon-containing fillers, metal oxides, metal carbides, or the mixture thereof.

Figure 5:
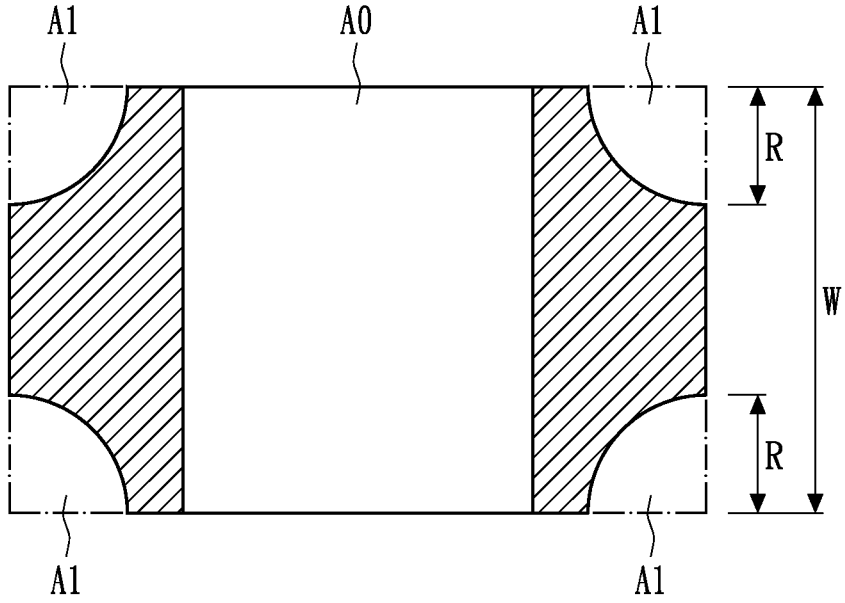
FIG. 5 shows the top view of the over-current protection device of the present application, indicating the relationship of the device and conductive vias.

It is known that small conductive vias may be partly or entirely removed if the cutter or the cutting line is misaligned. Therefore, the radius of the conductive via cannot be too small for misalignment concerns. For a device of 0603 type, the radius of the conductive via 48 is around 0.18 mm to 0.23 mm. For a device of 0402 type, the radius of the conductive via 48 is around 0.11 mm to 0.16 mm. In another aspect, the ratio of the sum of the cross-sectional areas of the four conductive vias 48 to form factor area of the over-current protection device 40 has to be greater than a certain value. As shown in FIG. 5, for a 0603 device, if a conductive via 48 has a radius of 0.18 mm, the cross-sectional area "A1" of the conductive via 48 is around 0.025 $mm^2$ (0.18×0.18×3.14)/4=0.025). Therefore, the total cross-sectional area of the conductive vias 48 is around 0.025 $mm^2$×4=0.1 $mm^2$. The form factor area "A0" of a 0603 type device is around 0.06 inch×0.03 inch=1.524 mm×0.762 mm=1.161 $mm^2$. The ratio of the total cross-sectional area of the four conductive vias to the form factor area of the over-current protection device (4×A1/A0) is approximately 9% (0.1 $mm^2$/1.161 $mm^2$). Likewise, the 4×A1/A0 ratios of various form factors and different sizes of conductive vias are shown in Table 1 below.

TABLE 1

| Form Factor | 0603 (A0 = 1.161 $mm^2$) | | 0402 (A0 = 0.516 $mm^2$) | |
|---|---|---|---|---|
| Radius of conductive via (mm) | 0.18 | 0.23 | 0.11 | 0.16 |

TABLE 1-continued

| Form Factor | 0603 (A0 = 1.161 mm$^2$) | | 0402 (A0 = 0.516 mm$^2$) | |
|---|---|---|---|---|
| Area of conductive via A1 (mm$^2$) | 0.025 | 0.042 | 0.009 | 0.02 |
| 4 × A1/A0 (%) | 9% | 14% | 7% | 16% |

In summary, the ratio of the sum of the cross-sectional areas of the four conductive vias to the form factor area of the over-current protection device (4×A1/A0) is approximately 7%-20%, or 8%-18% in particular. The ratio 4×A1/A0 may be 10% or 15% also. For the devices of 0402 type, 4×A1/A0 is around 7%-16%.

In another aspect, the ratio of the total width 2R of the conductive vias to the width W of a shorter side of the device has to be greater than a certain value. For the devices of 0603 type, the width of the shorter side of the device is 0.03 inches=0.762 mm. In the case that the radius R of the conductive via is 0.18 mm, the ratio of the total width of the conductive vias to the side width is 2×R/W=2×0.18 mm/0.762 mm=47%. Likewise, the 2×R/W ratios of various form factors and different hole sizes of conductive vias are shown in Table 2. The ratio is in the range of 42%-65%, or may be 45%, 50% or 55% in particular. In other words, the conductive vias occupy 42%-65% in width for a shorter side of the device.

TABLE 2

| Form Factor | 0603 | | 0402 | |
|---|---|---|---|---|
| Radius of conductive via (mm) | 0.18 | 0.23 | 0.11 | 0.16 |
| Width of a shorter side (mm) | 0.762 | 0.762 | 0.508 | 0.508 |
| 2 × R/W | 47% | 60% | 43% | 163% |

Figure 1:
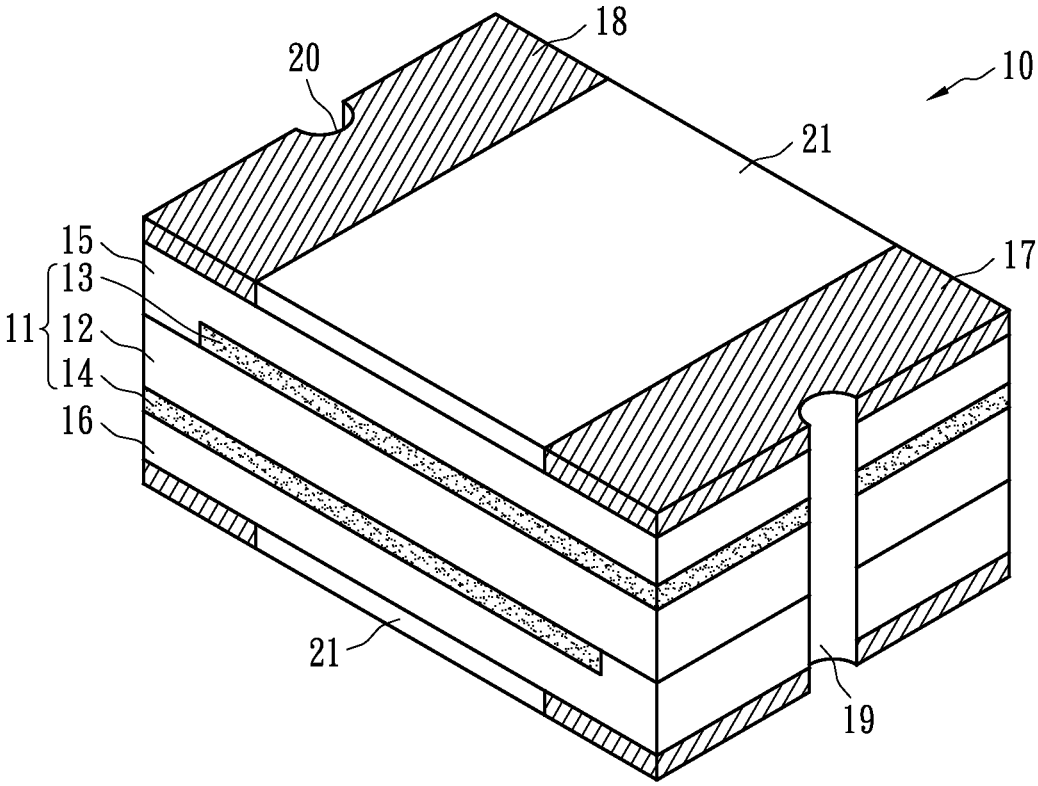
FIG. 1 (Prior Art)
FIG. 1 shows a known over-current protection device.
Figure 2A:
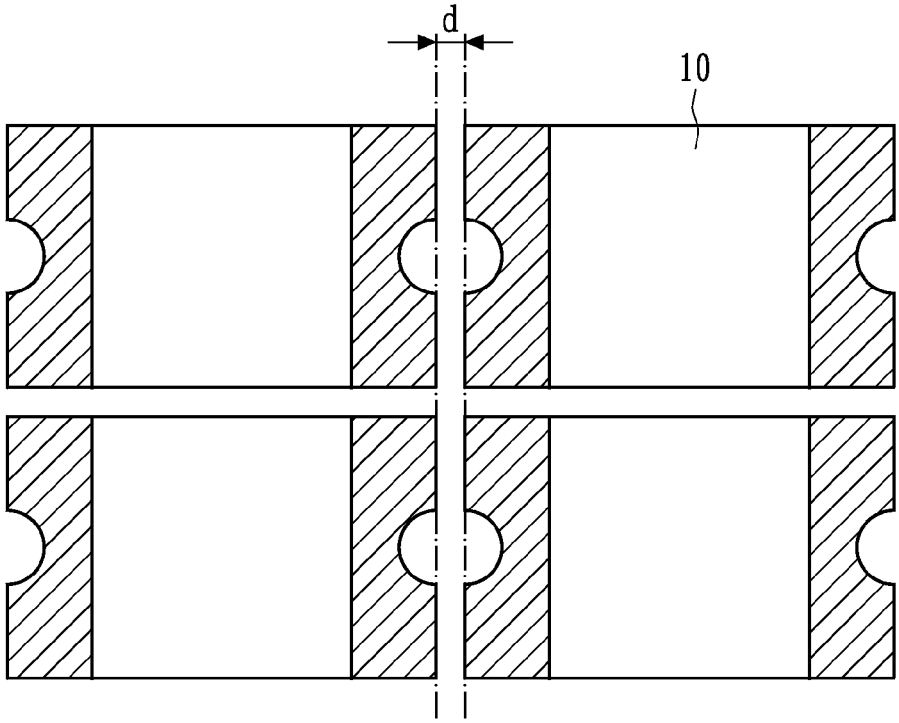
FIG. 2A (Prior Art)
FIGS. 2A and 2B show the cutting process for producing known over-current protection devices.
Figure 2B:
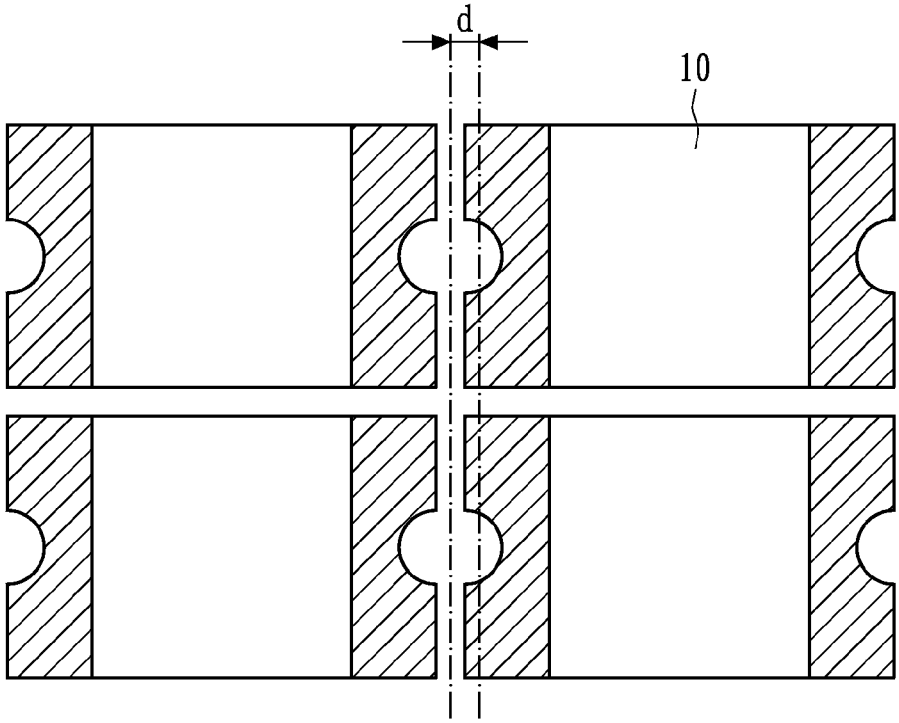
FIG. 2B (Prior Art)
Figure 3A:
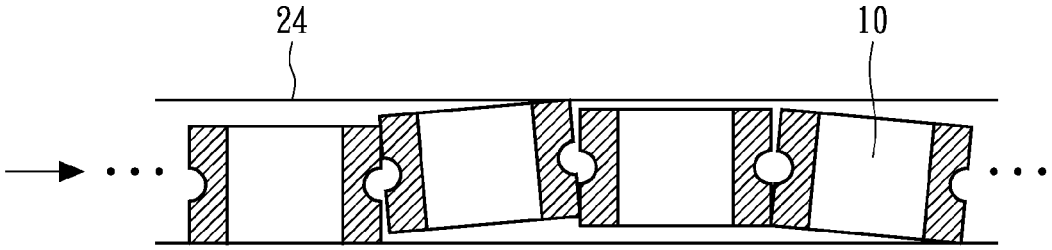
FIG. 3A (Prior Art)
FIGS. 3A and 3B show the transmission of known over-current protection devices.
Figure 3B:
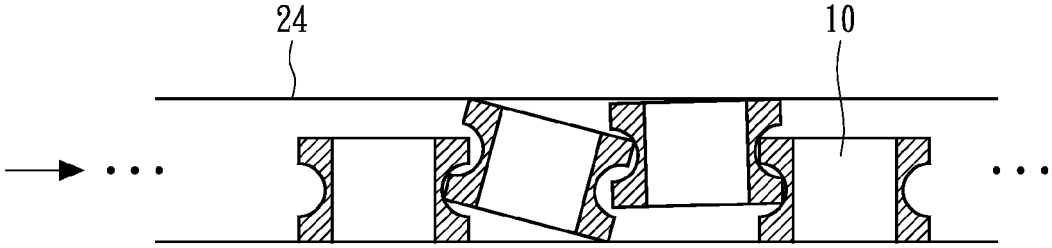
FIG. 3B (Prior Art)
Figure 6:
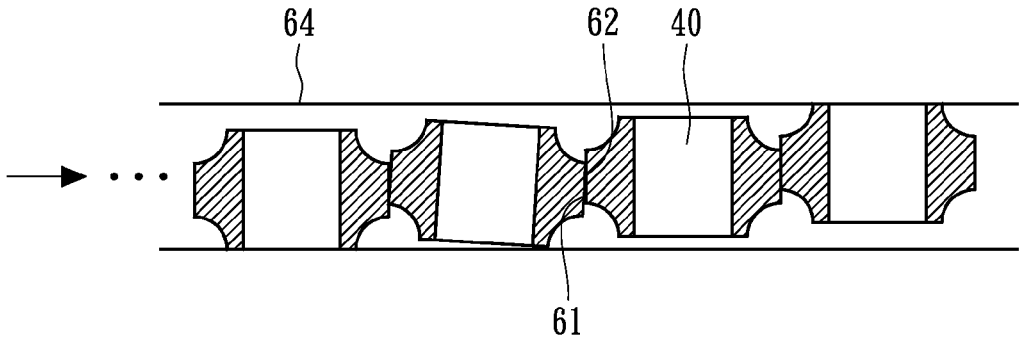
FIG. 6 shows the transmission of the over-current protection devices in accordance with the present application.

Referring to FIG. 6, because the conductive vias 48 are formed on the corners of adjacent planar lateral surfaces, a planar lateral surface 61 of a device 40 will abut against a planar lateral surface 62 of another neighboring device 40 when the devices 40 are being moved in a track 64 for appearance inspection or packaging. According to the present application, the center portions of the planar lateral surfaces 61 and 62 of the devices 40 have no concave vias. Even if the width of the conductive vias at the corners is more than 50% of the width of the planar lateral surface, as long as the ratio does not exceed 65%, the unstable transmission or blockage of devices shown in FIG. 3B will not occur.

The above embodiments relates to a device containing one PTC material layer. In practice, the device may comprise multiple PTC material layers connected in parallel, such as the two PTC material layers disclosed in U.S. Pat. No. 6,377,467. Similar to the device containing single PTC material layer, the device containing multiple PTC material layers comprises conductive vias placed at the corners of planar lateral surfaces, and the ratio of the sum of the areas of the conductive vias to the form factor area has to be in the specific range.

According to the present application, larger conductive vias are allowed to provide larger tolerance for device cutting, and to prevent devices from blockage during appearance inspection, resistance measurement and packaging process. Accordingly, the present application can increase not only manufacturing throughput but also the production yield.

The above-described embodiments of the present invention are intended to be illustrative only. Numerous alternative embodiments may be devised by persons skilled in the art without departing from the scope of the following claims.

What is claimed is:

1. An over-current protection device having opposite upper and lower surfaces and four planar lateral surfaces interconnecting the upper and lower surfaces, each of two adjacent ones of the four planar lateral surfaces defining a corner; the over-current protection device comprising:

a PTC material layer having opposite first and second surfaces;

a first conductive layer in physical contact with the first surface of the PTC material layer;

a second conductive layer in physical contact with the second surface of the PTC material layer;

a first electrode comprising a pair of first metal foils at the upper and lower surfaces, and being electrically connected to the first conductive layer and electrically isolated from the second conductive layer;

a second electrode comprising a pair of second metal foils at the upper and lower surfaces, and being electrically connected to the second conductive layer and electrically isolated from the first conductive layer; and four conductive vias each formed at the corner of two adjacent planar lateral surfaces, wherein two conductive vias connect the pair of the first metal foils and the first conductive layer, and the other two conductive vias connect the pair of the second metal foils and the second conductive layer; the sum of cross-sectional areas of the four conductive vias is around 7%-20% of a form factor area of the over-current protection device.

2. The over-current protection device of claim 1, further comprising:

a first insulating layer disposed on the first conductive layer; and a second insulating layer disposed on the second conductive layer;

wherein the first and second metal foils at the upper surface are disposed on the first insulating layer, and the first and second metal foils at the lower surface are disposed on the second insulating layer.

3. The over-current protection device of claim 1, wherein the form factor area is equal to or less than 1.161 mm$^2$.

4. The over-current protection device of claim 3, wherein one of the conductive vias has a cross-sectional area ranging from 0.025 to 0.042 mm$^2$.

5. The over-current protection device of claim 1, wherein the form factor area is equal to or less than 0.516 mm$^2$.

6. The over-current protection device of claim 5, wherein one of the conductive vias has a cross-sectional area ranging from 0.009 to 0.02 mm$^2$.

7. The over-current protection device of claim 5, wherein the sum of the cross-sectional areas of the four conductive vias is around 7%-16% of the form factor area of the over-current protection device.

8. The over-current protection device of claim 1, wherein the four planar lateral surfaces comprises opposite first planar lateral surface and second planar lateral surface, the first conductive layer extending to the first planar lateral surface and being isolated from the second planar lateral surface by a first gap, the second conductive layer extending to the second planar lateral surface and being isolated from the first planar lateral surface by a second gap.

9. The over-current protection device of claim 1, further comprising:

a first solder mask formed on the first insulating layer and between the first and second metal foils at the upper surface; and a second solder mask formed on the second insulating layer and between the first and second metal foils at the lower surface.

10. The over-current protection device of claim 1, wherein the over-current protection device is of a cuboid structure.

11. The over-current protection device of claim 1, wherein the conductive via has a quarter-round cross-section.

12. The over-current protection device of claim 1, wherein the conductive vias occupy 42%-65% in width for a shorter side of the over-current protection device.

* * * * *